United States Patent [19]

Walworth

[11] 4,165,986

[45] Aug. 28, 1979

[54] SUBSTITUTED-HALIDE SILVER HALIDE EMULSIONS AND PRODUCTS CONTAINING SAME

[75] Inventor: Vivian K. Walworth, Concord, Mass.

[73] Assignee: Polaroid Corporation, Cambridge, Mass.

[21] Appl. No.: 383,177

[22] Filed: Jul. 27, 1973

[51] Int. Cl.[2] ..... G03C 5/54; G03C 1/48; G03C 1/02; G03C 1/28

[52] U.S. Cl. ..... 96/29 R; 96/76 R; 96/94 R; 96/107

[58] Field of Search ..... 96/94 R, 76 R, 29 R, 96/77, 107, 3, 29 D

[56] References Cited

U.S. PATENT DOCUMENTS

| | | | |
|---|---|---|---|
| 2,592,250 | 4/1952 | Davey et al. | 96/94 R |
| 3,178,293 | 4/1965 | Bigelow | 96/108 |
| 3,573,055 | 3/1971 | Allentoff et al. | 96/108 |
| 3,615,579 | 10/1971 | Bigelow | 96/94 R |
| 3,622,318 | 11/1971 | Evans | 96/74 |
| 3,704,126 | 11/1972 | Land et al. | 96/29 R |
| 3,708,298 | 1/1973 | Vanreusel et al. | 96/107 |
| 3,730,716 | 5/1973 | Land et al. | 96/29 R |
| 3,782,954 | 1/1974 | Porter et al. | 96/94 R |
| 3,821,000 | 6/1974 | Land et al. | 96/76 R |

*Primary Examiner*—Richard L. Schilling
*Attorney, Agent, or Firm*—Stanley H. Mervis

[57] ABSTRACT

Photosensitive substituted-halide silver halide emulsions are prepared by substituting bromide and/or iodide anions for part of the chloride anions of a silver iodochloride emulsion. These substituted-halide silver halide emulsions are particularly useful as negative working silver halide emulsions in diffusion transfer processes.

24 Claims, 1 Drawing Figure

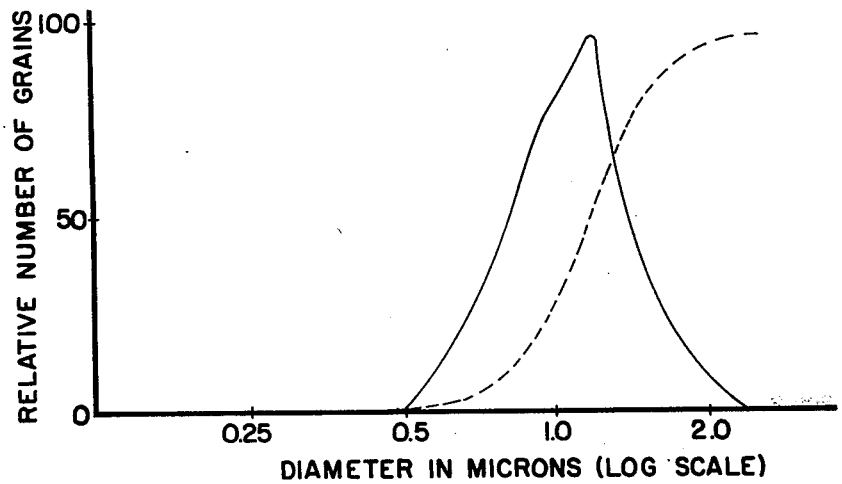
RELATIVE NUMBER OF GRAINS
100
50
0
0.25
0.5
1.0
2.0
DIAMETER IN MICRONS (LOG SCALE)

SUBSTITUTED-HALIDE SILVER HALIDE EMULSIONS AND PRODUCTS CONTAINING SAME

This invention relates to photosensitive silver halide emulsions, and more particularly to photosensitive silver halide emulsions comprising substituted-halide silver halide grains.

A primary object of this invention is to provide novel photosensitive silver halide emulsions comprising substituted-halide mixed halide silver halide grains by forming a silver iodochloride precipitate, and then substituting bromide ions, and optionally additional iodide ions, for part of the chloride ions of said silver iodochloride grains.

Further objects of the invention will in part be obvious and will in part appear hereinafter.

The invention accordingly comprises the process having the several steps and the order of one or more of such steps with respect to each of the others, and the product possessing the features, properties and the relation of elements which are exemplified in the following detailed disclosure, and the scope of the application of which will be indicated in the appended claims.

For a fuller understanding of the nature and objects of the invention, reference should be had to the following detailed description taken in connection with the accompanying drawing wherein:

The FIGURE reproduces a graph of the grain size-frequency distribution of the substituted-halide silver halide emulsion prepared in Example 1.

The term "substituted-halide silver halide grains" is used herein to refer to silver halide grains prepared by replacing or "substituting" a portion of the chloride anions of a silver iodochloride emulsion with bromide and/or iodide anions in an exchange reaction which may be described as a "simple metathesis" exchange reaction.

U.S. Pat. No. 2,592,250 issued Apr. 8, 1952 to Davey and Knott describes the preparation of a silver halide emulsion by "converting" a silver chloride emulsion to a silver halide which is less soluble in water than silver chloride, e.g., a silver iodobromide emulsion. (Certain similarities between the Davey-Knott emulsion making method and that used in the present invention will be apparent from the description given below.) The emulsions prepared by the Davey-Knott procedure have customarily been referred to as "internal latent image emulsions" and primarily have been utilized for their relatively high internal sensitivity and relatively low surface sensitivity, a property rendering them useful in providing direct positive images. It is known, however, that silver halide emulsions prepared by the Davey-Knott method of halide replacement may be surface chemically sensitized to increase their surface sensitivity relative to their internal sensitivity, as noted in U.S. Pat. No. 3,206,313 issued Sept. 14, 1965 to Porter, James and Lowe, and as described in detail in U.S. Pat. No. 3,622,318 issued Nov. 23, 1971 to Evans.

The present invention is concerned with the preparation of narrow grain size distribution substituted-halide silver halide emulsions the grains of which have a grain size distribution range and mean diameter rendering them particularly useful in diffusion transfer photography. In such uses, the substituted-halide silver halide emulsion is exposed in the normal manner and developed to provide a negative silver image of low contrast and low covering power while obtaining positive transfer images having highly desirable sensitometric properties, including, e.g., long dynamic ranges and high maximum density.

The substituted-halide silver halide emulsions provided by the present invention are characterized by having iodide in the core of the grain and a mean grain diameter within the range of about 0.7 to 1.5 microns, preferably within the range of about 1.0 to 1.5 microns. In the preferred embodiments, at least 80% of the silver halide grains will have a diameter within ± about 40% of the mean diameter. Particularly useful mean grain diameters are about 1.2 micron. The grains are also regular in crystal habit, i.e., they are generally polyhedra of three-fold symmetry, such as spheres, cubes, octahedra and nearly spherical, rounded-off octahedra or cubes. "Three-fold symmetry" is used here to mean symmetry about three mutually perpendicular axes. In a particularly useful embodiment, the layer of the substituted-halide silver halide emulsion as coated is substantially free of overlapping silver halide grains.

The substituted-halide silver halide emulsions of this invention are prepared by forming grains of silver iodochloride. Part of the chloride anions are then replaced with bromide, and optionally additional iodide, anions. In particularly useful embodiments the substituted-halide silver halide emulsion is a silver iodochlorobromide emulsion. The substituted-halide silver halide grains of this invention have a halide content of 1 to about 10 mole percent iodide, preferably about 1 to 6 percent iodide, and about 1 to 50 mole percent chloride, preferably about 10 to 50 mole percent chloride, the remaining halide being bromide. The halides are conveniently introduced in the form of the alkali metal halide salts. All of the iodide may be initially present during the formation of the silver iodochloride emulsion; alternatively part of the desired iodide may be introduced by replacing chloride anions. In the latter embodiment, the iodide anions may be added together with bromide anions, or prior to or after the addition of bromide anions. In the preferred embodiment, all of the iodide is present during the formation of the silver iodochloride emulsion.

The temperature of the solutions during formation of the silver iodochloride grains, during the halide-substitution step, and during the making and digestion stages is at least 60° C. and in the most useful embodiment it is at least 70° C. and preferably about 80° C.

The initial silver iodochloride emulsion is formed by simultaneous addition of the soluble silver salt and/or chloride and iodide solutions, and the subsequent addition of bromide and/or iodide salt solutions to effect the desired halide substitution also is effected rapidly. In practice, addition of the solutions within a period of about 3 to 20 minutes has been found to be desirable and beneficial in obtaining silver halide emulsions of desired grain size characteristics. Double jet addition techniques are especially adapted for obtaining desired grain size distributions.

The substituted-halide silver halide emulsions provided by this invention are particularly useful in diffusion transfer processes where they are used as negative working emulsions; development of the substituted-halide silver halide emulsion to a negative silver image is effected in the presence of a silver halide solvent. Under these conditions, both the surface latent image and the internal latent image may be utilized to give the desired negative image.

The examples set forth below of the preparation of substituted-halide silver halide emulsions in accordance with this invention are intended to be illustrative and non-limiting. Halide content was determined by X-ray fluorescence analysis.

EXAMPLE 1

A solution of gelatin and potassium chloride (Solution A) was prepared by dissolving 546 g. of phthalic anhydride derivatized inert bone gelatin and 546 g. of potassium chloride in 10,807 ml. of distilled water. A solution of potassium chloride and potassium iodide (Solution B) was prepared by dissolving 2,736 g. of potassium chloride and 180 g. of potassium iodide in 14,230 ml. of distilled water. A silver nitrate solution (Solution C) was prepared by dissolving 5,334 g. of silver nitrate in 14,230 ml. of water. Solution A was heated to 80° C. and Solutions B and C were heated to 70° C. Solutions B and C were then added to Solution A by double jet addition at a rate of about 830 ml. per minute over about 18 minutes. The resulting mixture was digested 5 minutes at 80° C. After this digestion period, a solution of 2,932 g. of potassium bromide dissolved in 14,230 ml. of water and heated to 70° C. was added at a rate of about 780 ml. per minute over about 20 minutes, keeping the temperature at 80° C. The mixture was then digested for 35 minutes at 80° C. After the digestion period, the mixture was cooled to 20° C. and the pH adjusted to about 2.7 with 10% sulfuric acid. The precipitate of gelatin and silver halide was washed several times with chilled, distilled water until the supernatant liquid reached a conductivity of 50–100 μmhos. After the last decantation of excess wash water, 2,534 g. of dry active bone gelatin was added and allowed to swell for 20 minutes. The temperature was then raised to 38° C. and held there for 20 minutes while the gelatin dissolved. The pH was adjusted to 5.7 with 10% sodium hydroxide, and the pAg was adjusted to 9.0 with 2.0 N potassium chloride. The temperature was raised to 54° C. and 64 ml. of a solution of an ammonium gold thiocyanate complex was added. (This chemical sensitizer solution was prepared by mixing a solution of 1.0 g. of ammonium thiocyanate in 99 ml. of water with 12 ml. of a solution containing 0.97 g. of gold chloride in 99 ml. of water.) The emulsion was then afterripened at 54° C. for 90 minutes. 34.6 ml. of a 10% slightly alkaline solution of 4-hydroxy-6-methyl-1,3,3a,7-tetrazaindene was then added. The emulsion was cooled to 38° C., panchromatic optical sensitizer added and the emulsion digested for about 10 minutes before being chilled and set. The resultant silver iodochlorobromide emulsion contained approximately 79 mole percent bromide, 18 mole percent chloride and 3 mole percent iodide. The silver iodochlorobromide grains had a mean diameter of about 1.2 micron, and 80% of the grains had a diameter within the range of about 0.8 to 1.6 microns, or within ±33% of the mean diameter. 90% of the silver halide grains had a diameter within the range of 0.72 to 1.77 microns, or within −40% and +48% of the mean diameter. The grain size-frequency distribution curve for this emulsion had a dispersion number of 0.55.

Grain size distribution curves, or grain size-frequency distribution curves as they are sometimes called, are frequently used to describe and define silver halide emulsions. Mees and James, *The Theory of the Photographic Process*, 3rd Edition, The Macmillan Company, New York, N.Y., 1966, pages 36–44, set forth a description of techniques of measuring the size of silver halide grains and of determining the frequency of grains of given sizes in a particular silver halide emulsion. Electron microscope size-frequency analysis of silver halide emulsions gives very high accuracy measurements particularly useful with grains too small to resolve well by light microscopy.

The FIGURE depicts a grain size-frequency distribution curve of particle sizes (1,000 grains) determined using a Zeiss TGZ-3 particle size analyzer to obtain counts from electron micrographs of the silver halide emulsion prepared in Example 1. The horizontal axis represents relative log diameter in microns of the silver halide grains, while the vertical axis represents the relative number of grains, with the dotted curve representing cumulative percentile. For the silver halide emulsion prepared in Example 1, the mean particle diameter was 1.2 micron. Visual examination of the grain size-frequency distribution curve reproduced in the FIGURE graphically demonstrate the narrow distribution of the substituted-halide silver halide emulsion prepared in Example 1.

It is also possible to characterize the grain size distribution of a silver halide emulsion by use of the "dispersion number" of the grain size-frequency distribution curve, i.e., the number obtained as follows: the grain size diameter at the 16th percentile is subtracted from the grain size diameter at the 84th percentile, and the resulting number is divided by the median diameter. The smaller the dispersion number, the narrower will be the band width of the grain size-frequency distribution curve. The dispersion number for the silver halide emulsion prepared in Example 1 was 0.55. The silver halide emulsions of the present invention have a dispersion number of 0.70 or less, and preferably 0.55 or less.

EXAMPLE 2

A solution of gelatin and potassium chloride (Solution A) was prepared by dissolving 205 g. of phthalic anhydride derivatized inert bone gelatin and 205 g. of potassium chloride in 8,105 ml. of distilled water. A solution of potassium chloride and potassium iodide (Solution B) was prepared by dissolving 1,026 g. of potassium chloride and 45 g. of potassium iodide in 5,336 ml. of distilled water. A silver nitrate solution (Solution C) was prepared by dissolving 2,000 g. of silver nitrate in 5,336 ml. of water. Solution A was heated to 80° C. and Solutions B and C were heated to 60° C. Solutions B and C were then added to Solution A by double jet addition at a rate of about 712 ml. per minute over about 8 minutes. The resulting mixture was digested 8 minutes at 80° C. After this digestion period, a solution of 1,337 g. of potassium bromide and 15 g. of potassium iodide dissolved in 5,336 ml. of water and heated to 60° C. was added at a rate of about 712 ml. per minute over about 5 minutes, keeping the temperature at 80° C. The mixture was then digested for 35 minutes at 80° C. After the digestion period, the mixture was cooled to 20° C. and the pH adjusted to about 2.7 with 10% sulfuric acid. The precipitate of gelatin and silver halide was washed several times with chilled, distilled water until the supernatant liquid reached a conductivity of 50–100 μmhos. After the last decantation of excess wash water, 950 g. of dry active bone gelatin was added and allowed to swell for 20 minutes. The temperature was then raised to 38° C. and held there for 20 minutes while the gelatin dissolved. The pH was adjusted to 5.7 with 10% sodium hydroxide, and the pAg was adjusted to 9.0 with 2.0 N potassium chloride. The temperature was raised to 54° C. and 64 ml. of a solution of an ammonium gold thiocyanate complex was added. (This chemical sensitizer solution was prepared by mixing a solution of 1.0 g. of ammonium thiocyanate in 99 ml. of water with 12 ml. of a solution containing 0.97 g. of gold chloride in 99 ml. of water.) The emulsion was then afterripened at 54° C. for 47 minutes. The emulsion was cooled to 38° C., panchromatic optical sensitizer added and the emulsion agitated for about 45 minutes before being chilled and set. The silver iodochlorobromide grains had a mean diameter of about 0.83 micron, and 80% of the grains had a diameter within the range of about 0.8 to 1.6 microns, or within ±33% of the mean diameter. 90% of the silver halide grains had a diameter within −37% and +41% of the mean diameter. The grain size-frequency curve had a dispersion number of 0.38.

EXAMPLE 3

800 g. of inert bone gelatin was swollen in 8,800 ml. of distilled water for 20 minutes. The temperature was raised to 40° C. and the gelatin was dissolved with agitation. The pH of the gelatin solution was adjusted to a pH of 10.0 with 50% sodium hydroxide. While maintaining the temperature at 40° C., 88 g. of phthalic anhydride dissolved in 616 ml. of acetone was gravity fed into the gelatin solution over a 30 minute period, maintaining the pH at 10.0 with 50% sodium hydroxide. The solution was slowly agitated at 40° C. for another 30 minutes, after which the pH was adjusted to 6.0 with sulfuric acid. A gelatin solution (Solution A) was prepared which comprised 5,750 ml. of distilled water, 2,560 g. of the above-prepared phthalic anhydride derivatized gelatin and 205 g. of potassium bromide. A potassium chloride and potassium iodide solution (Solution B) was prepared by dissolving 1,026 g. of potassium chloride and 60 g. of potassium iodide in 5,336 ml. of distilled water. A silver nitrate solution (Solution C) was prepared by dissolving 2,000 g. of silver nitrate in 5,336 g. of distilled water. Solution A was heated to 80° C. Solutions B and C were heated to 60° C. and added to Solution A by double jet addition at a rate of 1,800 ml. per minute over about 3½ minutes, maintaining Solution A at 80° C. The resulting mixture was digested 5 minutes at 80° C. After this digestion period, a solution of 1,337 g. of potassium bromide dissolved in 5,336 ml. of water was added at a rate of about 1,800 ml. per minute over about 3½ minutes, keeping the temperature at 80° C. The mixture was then digested for 35 minutes at 80° C. After the digestion period, the mixture was cooled to 20° C. and the pH adjusted to about 2.7 with 10% sulfuric acid. The precipitate of gelatin and silver halide was washed several times with chilled, distilled water until the supernatant liquid reached a conductivity of 50–100 μmhos. After the last decantation of excess wash water, 950 g. of dry active bone gelatin was added and allowed to swell for 20 minutes. The pH was adjusted to 5.70 with 10% sodium hydroxide and gold sensitizer added as in Example 1. The temperature was raised to 51° C. and the emulsion was after-ripened for 150 minutes. The emulsion was cooled to 38° C., a panchromatic optical sensitizer added and the emulsion was digested for 45 minutes before being chilled and set. The silver halide emulsions had a mean diameter of about 0.78 micron and a dispersion number of 0.66. 80% of the silver halide grains had a diameter within +55% and −30% of the mean diameter, i.e., with the range of 0.55 and 1.2 microns.

It has been found that substituted-halide silver halide emulsions prepared in accordance with this invention exhibit increased film speed, e.g., an increase of about a stop when used in diffusion transfer processes, and a longer dynamic range, as compared with substituted-halide silver halide emulsions having the same mean diameter and comparable halide content but prepared by having all the iodide added after the silver chloride grains have been formed. The substituted-halide mixed halide silver halide emulsions of this invention are characterized by a minimum of small grains, and the relatively narrow grain size distribution is skewed in favor of larger size grains, if not symmetrical.

It has been found that the grain size may be controlled to obtain desired mean diameters by controlling and varying one or more of the duration of the initial silver chloride precipitation, the temperature during the silver chloride precipitation and the chloride to silver ratio in the silver chloride precipitation. In general, larger mean grain diameters are obtained by use of longer silver chloride precipitation time, higher temperature and/or higher ratio of chloride to silver. It is also within the scope of this invention to form the silver halide grains in the presence of additives known to control grain size and/or shape. Varying the molar ratio of chloride to silver in the making step is a particularly effective way of controlling the grain size distribution characteristics of the substituted-silver halide emulsions. Use of a large molar excess of chloride is particularly useful in obtaining larger grains.

The pAg during afterripening of the emulsion is preferably within the range of about 8 to 9. Adjustment of pAg may be effected by the addition of chloride ions or a mixture of chloride and bromide ions. Addition of chloride also has been found to increase the stability of the silver halide emulsion to prolonged heating.

For black-and-white applications, optical sensitization may be by a single panchromatic sensitizer or by a mixture of suitable optical sensitizers. Similarly, the substituted-halide silver halide emulsions may be color sensitized for use as blue-, green- or red-sensitive emulsions in subtractive color photography. It is not necessary to optically sensitize if the intended use does not require particular color sensitivity.

In the above examples, the substituted-halide silver halide emulsion grains were chemically sensitized to increase the surface sensitivity. Such chemical sensitization is not essential, however, in order to develop an exposed substituted-halide silver halide emulsion to a negative image, especially if said exposed emulsion is developed in the presence of a silver halide solvent.

As stated above, the substituted-halide silver halide emulsions of this invention are particularly useful as negative working emulsions. They may be chemically sensitized, optically sensitized, coated, stabilized, etc., in the same manner and with the same reagents and aids as conventional negative working silver halide emulsions, i.e., silver halide emulsions prepared without the halide substitution or metathesis. The silver halide emulsions of this invention may be coated on transparent or paper supports, and at silver levels of about 30 to 250 mg./ft.$^2$, depending upon the particular application.

The substituted-halide mixed silver halide emulsions of this invention are particularly useful in silver diffusion transfer processes, including processes for forming additive color transparencies such as are disclosed and claimed in the copending application of Edwin H. Land, Ser. No. 383,196, (now U.S. Pat. No. 3,894,871 issued July 15, 1975) filed concurrently herewith. These substituted-halide mixed silver halide emulsions are also useful in multicolor diffusion transfer processes, particularly multicolor dye developer transfer processes, as disclosed and claimed in the copending application of Edwin H. Land, Ser. No. 383,195, (now U.S. Pat. No. 3,976,486 issued Aug. 24, 1976) filed concurrently herewith.

Since certain changes may be made in the above products and processes without departing from the scope of the invention herein involved, it is intended that all matter contained in the above description or shown in the accompanying drawing shall be interpreted as illustrative and not in a limiting sense.

What is claimed is:

1. A light-sensitive photographic emulsion comprising substituted-halide silver halide grains containing iodide in the core thereof, said grains containing about 1 to about 50 mole percent chloride, about 1 to about 10 mole percent iodide, the remaining halide in said grains being bromide, said substituted-halide silver halide grains having been prepared by the replacement of a portion of the chloride anions of silver iodochloride grains with bromide or bromide and iodide anions.

2. A light-sensitive photographic emulsion as defined in claim 1 wherein said substituted-halide silver halide grains have a mean diameter within the range of about 0.7 to 1.5 micron.

3. A light-sensitive photographic emulsion as defined in claim 2 wherein at least 80% of said silver halide grains have a diameter within ±40% of said mean diameter.

4. A light-sensitive photographic emulsion as defined in claim 1 wherein said chloride content is about 10 to 50%.

5. A light-sensitive photographic emulsion as defined in claim 2 wherein said mean diameter is about 1.2 microns.

6. A light-sensitive photographic emulsion as defined in claim 1 wherein said iodide content is about 1 to 6%.

7. A light-sensitive photographic emulsion as defined in claim 1 wherein the surface of said grains is chemically sensitized.

8. A photographic element comprising a support carrying a layer of light-sensitive substituted-halide silver halide grains containing iodide in the core thereof, said grains containing about 1 to about 50 mole percent chloride, about 1 to about 10 mole percent iodide, the remaining halide in said grains being bromide, said substituted-halide silver halide grains having been prepared by the replacement of a portion of the chloride anions of silver iodochloride grains with bromide or bromide and iodide anions.

9. A photographic element as defined in claim 8 wherein said substituted-halide silver halide grains have a mean diameter within the range of about 0.7 to 1.5 microns.

10. A photographic element as defined in claim 9 wherein said substituted-halide silver halide grains have a mean diameter of about 1.2 microns.

11. A photographic element as defined in claim 9 wherein at least 80% of said silver halide grains have a diameter within ±40% of said mean diameter.

12. A photographic element as defined in claim 8 wherein the chloride content of said silver halide grains is about 10 to about 50 mole percent.

13. A photographic element as defined in claim 8 wherein said grains are surface chemically sensitized.

14. A photographic element as defined in claim 8 wherein said layer of substituted-halide silver halide grains contains about 30 to 250 mg. of silver per square foot.

15. A photographic element as defined in claim 8 wherein said layer of substituted-halide silver halide grains is substantially free of overlapping silver halide grains.

16. A photographic element as defined in claim 8 wherein said support is a polyester film base.

17. The process of forming a positive diffusion transfer image comprising exposing to a subject a layer of substituted-halide silver halide grains containing iodide in the core, said silver halide grains containing 1 to about 50 mole percent chloride, 1 to about 10 mole percent iodide, the remaining halide being bromide, said silver halide grains having been prepared by the replacement of a portion of the chloride anions of silver iodochloride grains with bromide or bromide and iodide anions, developing said exposed substituted-halide silver halide emulsion to a negative image of said subject, said development being effected in the presence of a silver halide solvent, and transferring an imagewise distribution of diffusible silver halide complex from undeveloped areas of said substituted-halide silver halide emulsion to an image-receiving layer in superposed relationship with said substituted-halide silver halide emulsion layer to provide a diffusion transfer positive silver image of said subject.

18. The process as defined in claim 17 wherein said silver halide solvent is an alkali metal thiosulfate.

19. The process as defined in claim 17 wherein said substituted-halide silver halide emulsion layer contains about 30 to 250 mg. of silver per square foot.

20. The process as defined in claim 19 wherein said substituted-halide silver halide grains are surface chemically sensitized.

21. The process as defined in claim 17 wherein said silver halide grains have a mean diameter within the range of about 1.0 to 1.5 microns, with at least 80% of said silver halide grains having a diameter within ±40% of said mean diameter.

22. A light-sensitive photographic emulsion as defined in claim 1 wherein said substituted-halide silver halide grains have a mean diameter within the range of about 1.0 to 1.5 microns.

23. A photographic element as defined in claim 8 wherein said substituted-halide silver halide grains have a mean diameter within the range of about 1.0 to 1.5 microns.

24. The process as defined in claim 17 wherein said silver halide grains have a mean diameter within the range of about 0.7 to 1.5 microns, with at least 80% of said silver halide grains having a diameter within ±40% of said mean diameter.

* * * * *